US008020871B2

(12) United States Patent
Lin

(10) Patent No.: US 8,020,871 B2
(45) Date of Patent: Sep. 20, 2011

(54) BOARD GAME WITH THREE-DIMENSIONAL MOVEMENT

(76) Inventor: Hung-Pin Lin, Sijhih (TW)

( * ) Notice: Subject to any disclaimer, the term of this patent is extended or adjusted under 35 U.S.C. 154(b) by 0 days.

(21) Appl. No.: 12/688,024

(22) Filed: Jan. 15, 2010

(65) Prior Publication Data

US 2011/0175287 A1 Jul. 21, 2011

(51) Int. Cl.
*A63F 3/00* (2006.01)

(52) U.S. Cl. ..... 273/287; 273/157 R

(58) Field of Classification Search ..... 273/153 R, 273/157 R, 287
See application file for complete search history.

(56) References Cited

U.S. PATENT DOCUMENTS

| | | | | |
|---|---|---|---|---|
| 2,506,189 | A * | 5/1950 | Attridge | 273/157 R |
| 2,825,568 | A * | 3/1958 | Birsh | 273/157 R |
| 4,515,371 | A * | 5/1985 | Basevi | 273/260 |
| 5,405,146 | A * | 4/1995 | Washington | 273/157 R |
| 5,425,540 | A * | 6/1995 | Senel | 273/239 |
| 5,725,213 | A * | 3/1998 | Kuczynski | 273/153 S |
| 6,237,270 | B1 * | 5/2001 | Kovar | 40/725 |

* cited by examiner

*Primary Examiner* — Vishu K. Mendiratta
(74) *Attorney, Agent, or Firm* — Alan Kamrath; Kamrath & Associates PA

(57) ABSTRACT

A board game includes a board assembly and an operation unit mating with the board assembly. The board assembly includes at least one outer frame, at least one inner board mounted in the outer frame and a plurality of separating edges located in the outer frame and the inner board to separate the outer frame and the inner board respectively. The outer frame of the board assembly includes a plurality of sections which are juxtaposed and combined to form an endless loop. Thus, the outer frame and the inner board of the board assembly co-operate to function as a monopoly and a puzzle so as to enhance the amusement of playing the board game.

13 Claims, 16 Drawing Sheets

BOARD GAME WITH THREE-DIMENSIONAL MOVEMENT

BACKGROUND OF THE INVENTION

1. Field of the Invention

The present invention relates to a game that is played by multiple players and, more particularly, to a board game with a three-dimensional movement.

2. Description of the Related Art

A conventional monopoly comprises a plurality of blocks or sections which are juxtaposed and combined to form an endless loop which usually has a rectangular shape. The blocks or sections can be detached to increase the diversity of the monopoly. Thus, each of the blocks or sections represent a capital so that the players can purchase the capitals of the blocks or sections. However, the conventional monopoly only has a single function and cannot function as a puzzle, thereby limiting the versatility and amusement of the conventional monopoly. In addition, the blocks or sections have a planar shape and cannot present a three-dimensional outlook or profile, thereby decreasing the aesthetic quality of the conventional monopoly.

BRIEF SUMMARY OF THE INVENTION

In accordance with the present invention, there is provided a board game, comprising a board assembly and an operation unit mating with the board assembly. The board assembly includes at least one outer frame, at least one inner board mounted in the outer frame and a plurality of separating edges located in the outer frame and the inner board to separate the outer frame and the inner board respectively. The outer frame of the board assembly includes a plurality of sections which are juxtaposed and combined to form an endless loop.

According to the primary objective of the present invention, the outer frame and the inner board of the board assembly co-operate to function as a monopoly and a puzzle to facilitate a player or many players playing the monopoly and the puzzle so as to enhance the amusement of playing the board game.

According to another objective of the present invention, the board assembly includes a plurality of connecting blocks mounted between the outer frames to connect the outer frames so as to expand the board game.

According to a further objective of the present invention, both of the outer frame and the inner board have a stepped shape so that the board assembly has a three-dimensional effect to enhance the aesthetic quality of the board game.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
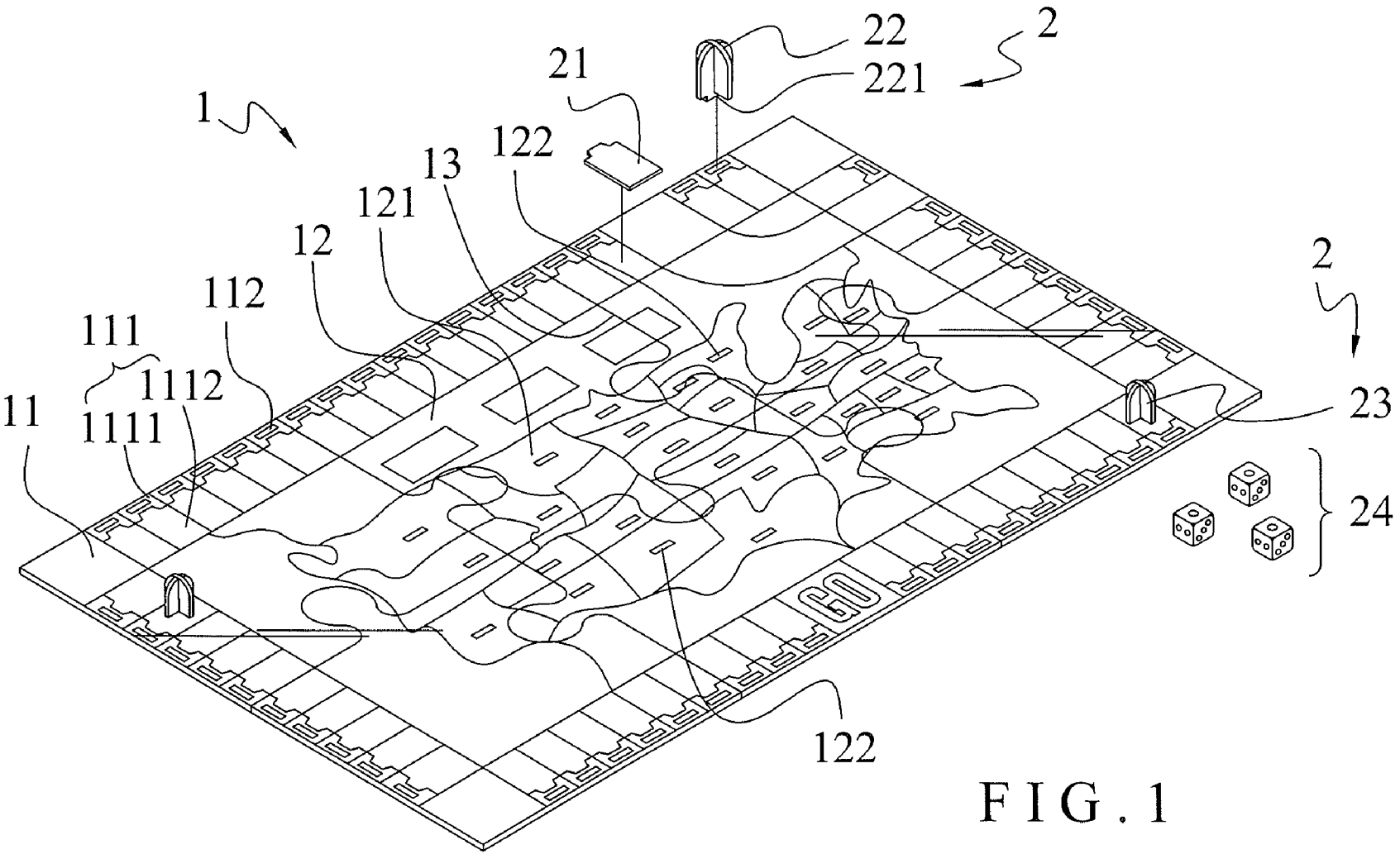
FIG. 1 is a perspective view of a board game in accordance with the preferred embodiment of the present invention.

Referring to the drawings and initially to FIGS. 1-7, a board game in accordance with the preferred embodiment of the present invention comprises a board assembly 1 and an operation unit 2 mating with the board assembly 1.

The board assembly 1 includes at least one outer frame 11, at least one inner board 12 mounted in the outer frame 11, and a plurality of separating edges 13 located in the outer frame 11 and the inner board 12 to separate the outer frame 11 and the inner board 12 respectively.

The outer frame 11 of the board assembly 1 has a determined thickness and includes a plurality of sections 111 which are juxtaposed and combined to form an endless loop. Each of the sections 111 of the outer frame 11 has a surface provided with at least one slot 112. Preferably, each of the sections 111 of the outer frame 11 includes a first zone 1111 and a second zone 1112 juxtaposed to the first zone 1111.

Figure 4:
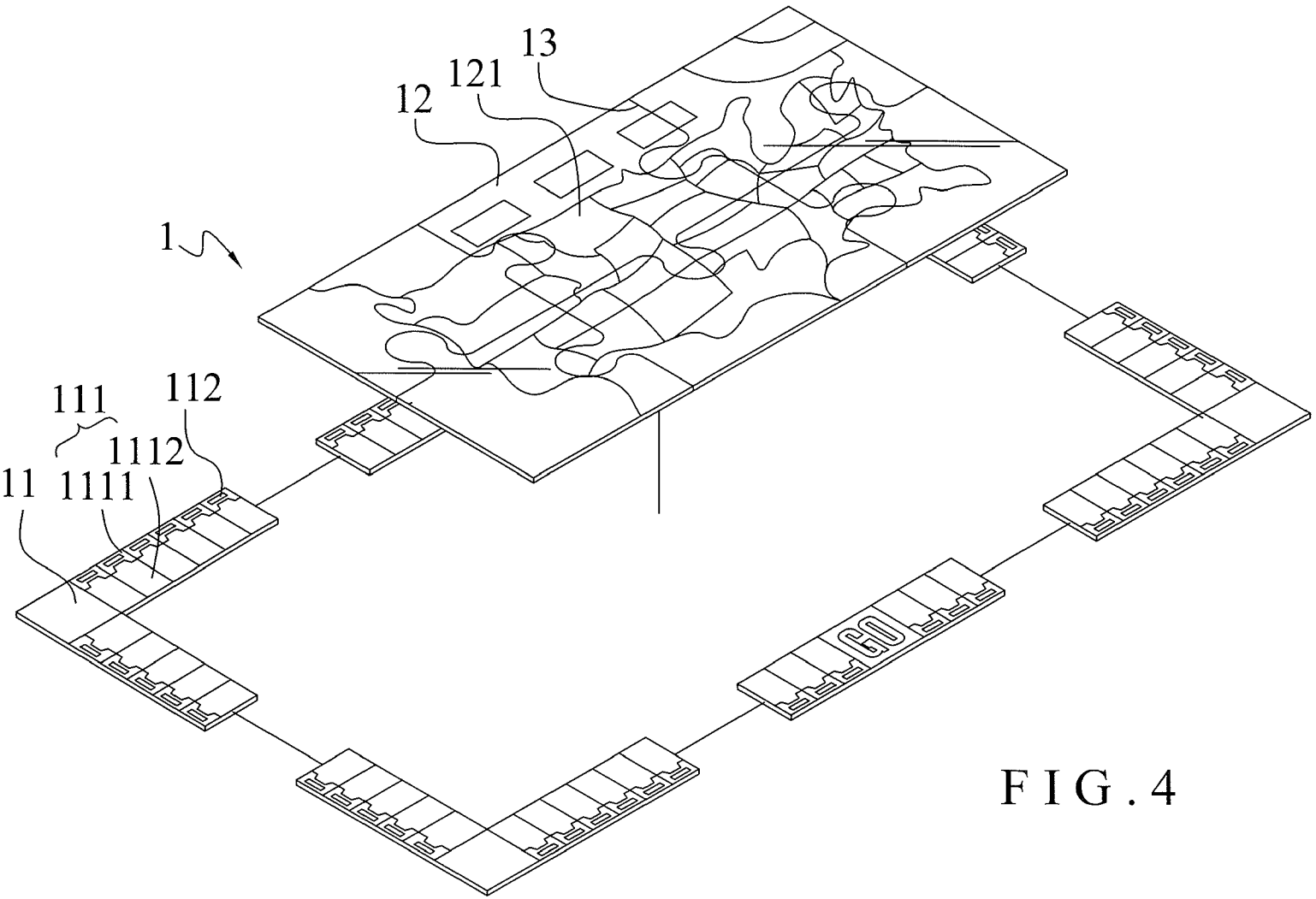
FIG. 4 is a partially perspective exploded view of the board game as shown in FIG. 1.

The inner board 12 of the board assembly 1 is detachably mounted in and surrounded by the outer frame 11 so that the inner board 12 of the board assembly 1 can be detached from the outer frame 11 as shown in FIG. 4. Thus, the inner board 12 of the board assembly 1 is used individually to function as a puzzle, and the outer frame 11 of the board assembly 1 is used individually to function as a monopoly. The inner board 12 of the board assembly 1 includes a plurality of figure blocks 121 which have an information corresponding to that of the sections 111 of the outer frame 11 respectively. Each of the figure blocks 121 of the inner board 12 has a surface provided with at least one slot 122.

Figure 2:
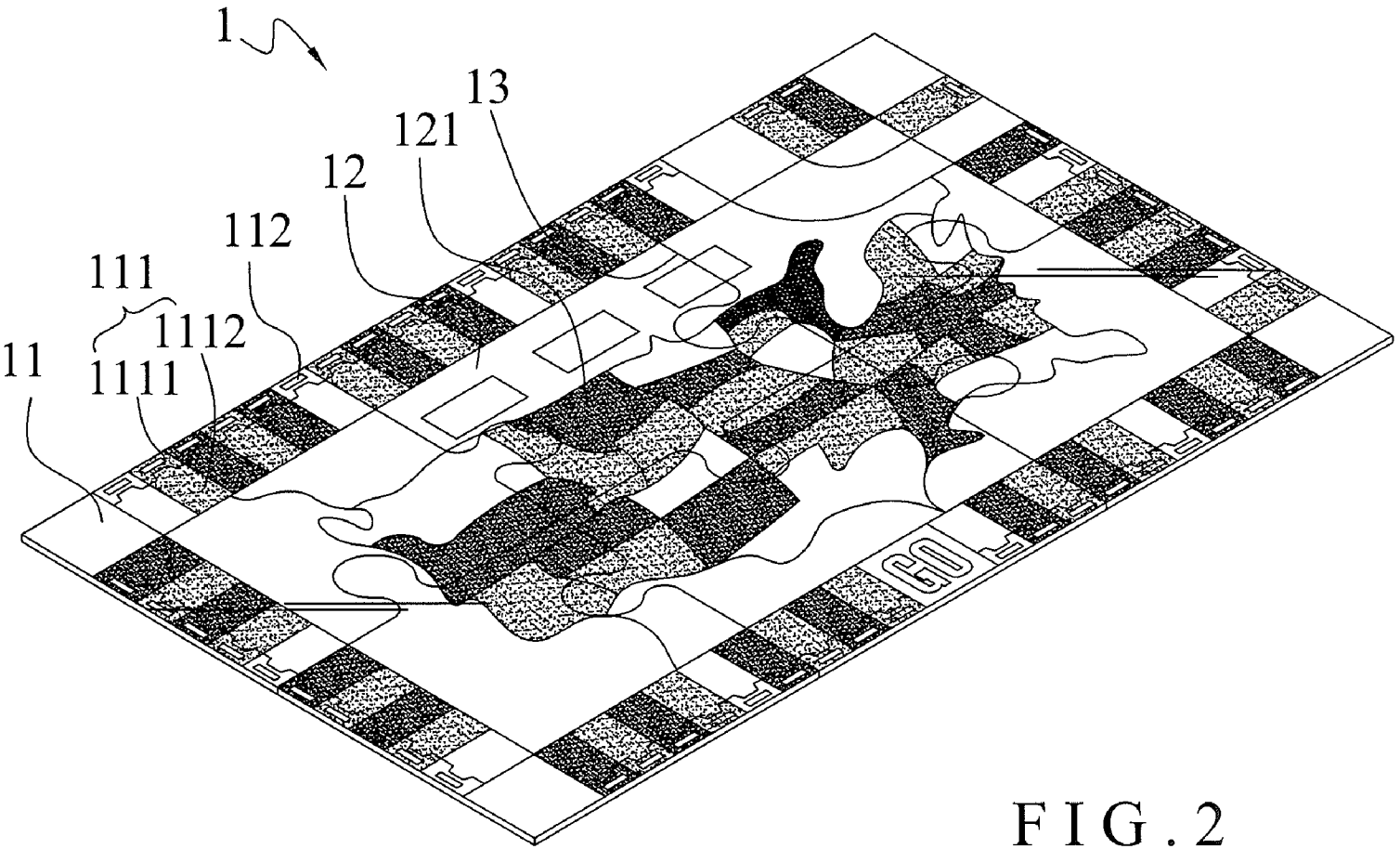
FIG. 2 is a partially perspective view of the board game as shown in FIG. 1.

In practice, when the sections 111 of the outer frame 11 represent a city, such as the New York city, the figure blocks 121 of the inner board 12 present the outlook or profile of the city to correspond to the sections 111 of the outer frame 11 respectively. Preferably, the figure blocks 121 of the inner board 12 have different colors to correspond to that of the sections 111 of the outer frame 11 respectively as shown in FIG. 2.

Figure 3:
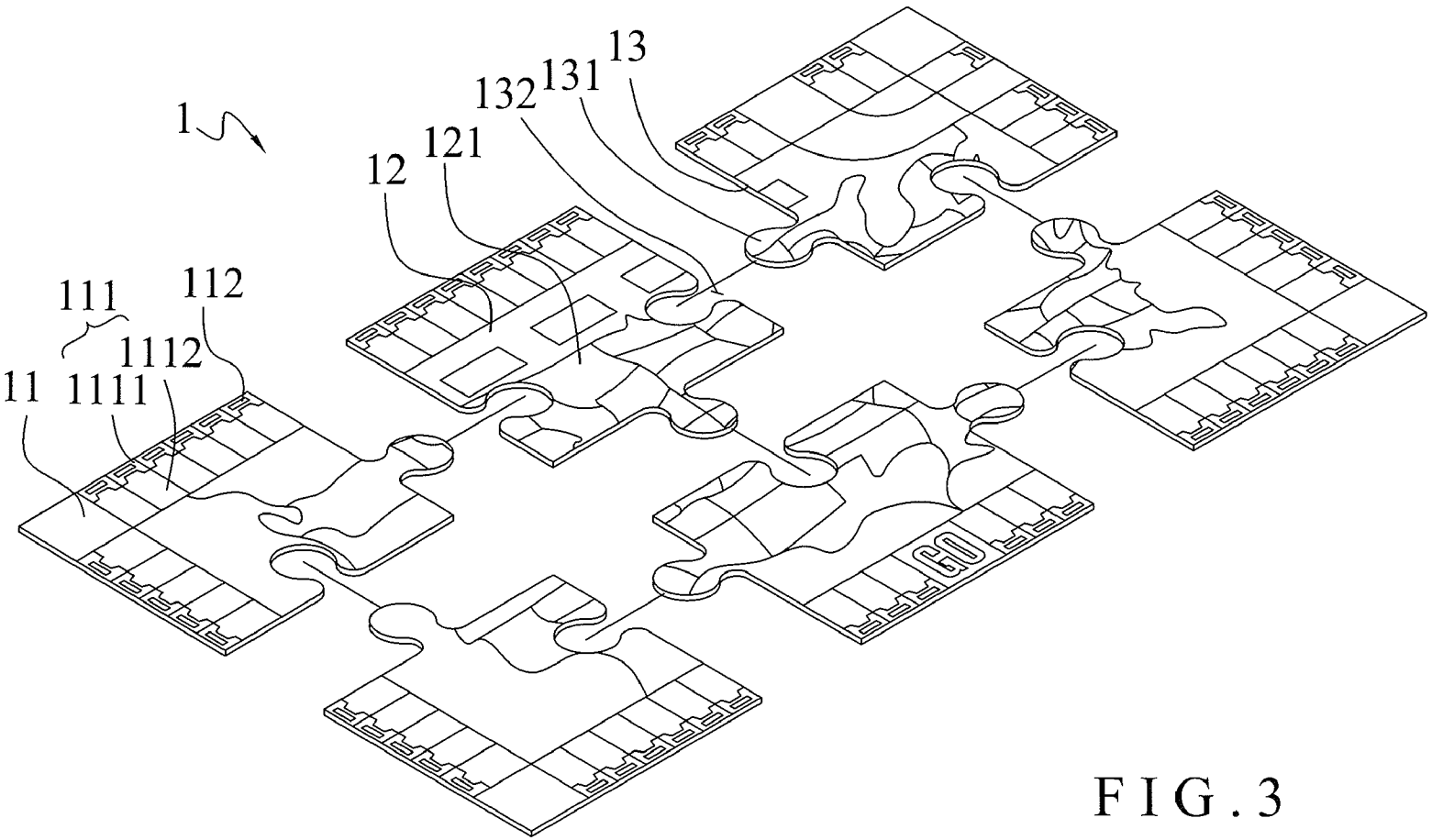
FIG. 3 is a partially perspective exploded view of the board game as shown in FIG. 1.
Figure 5:
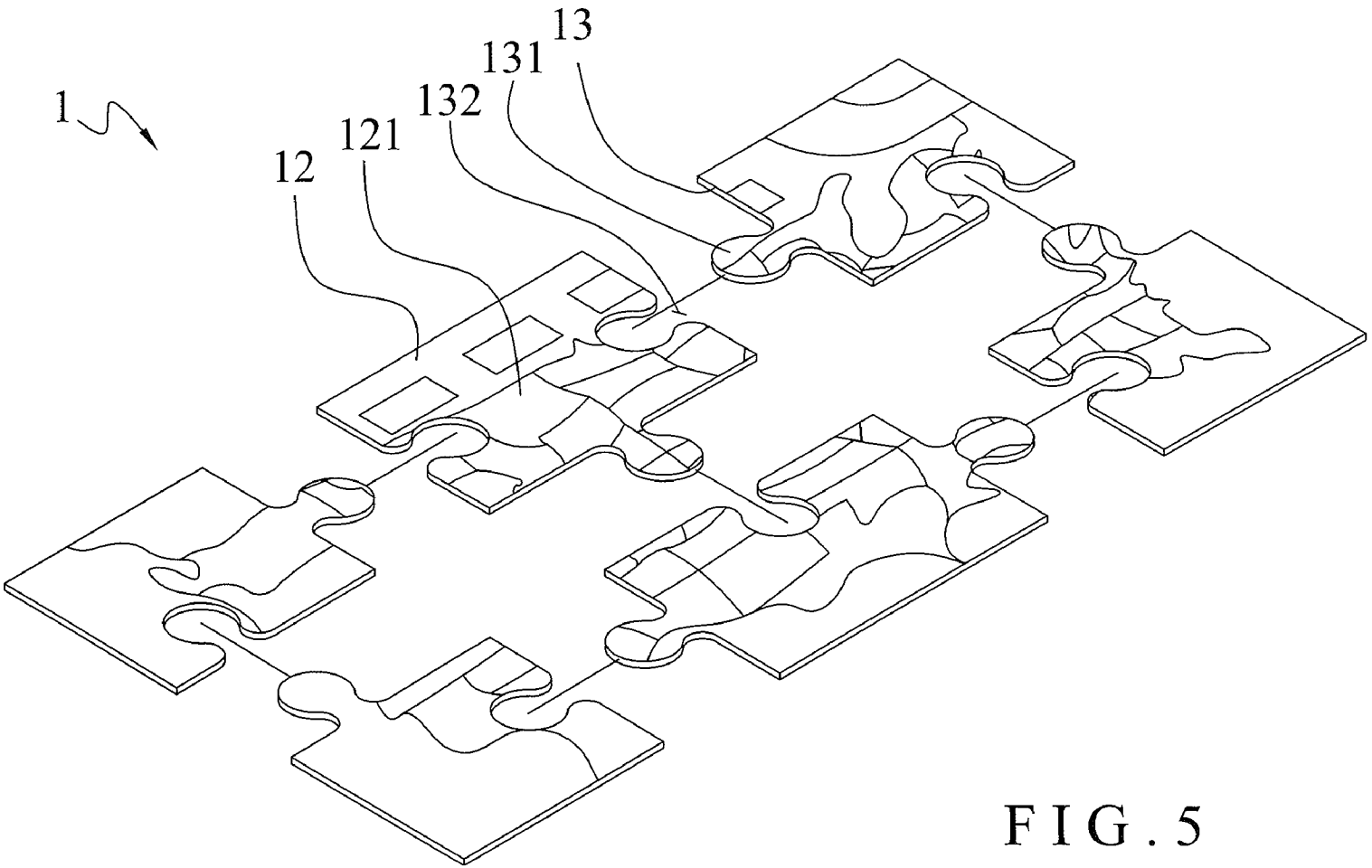
FIG. 5 is a partially perspective exploded view of the board game as shown in FIG. 1.

The separating edges 13 of the board assembly 1 divides the outer frame 11 and the inner board 12 of the board assembly 1 into a plurality of pieces as shown in FIG. 3 so that the pieces of the outer frame 11 and the inner board 12 of the board assembly 1 are combinable and detachable. The separating edges 13 of the board assembly 1 includes a plurality of concave portions 132 corresponding to some of the pieces of the board assembly 1 respectively and a plurality of convex portions 131 corresponding to some of the pieces of the board assembly 1 respectively and detachably inserted into the concave portions 132 to combine or detach the pieces of the board assembly 1 respectively as shown in FIGS. 3 and 5.

The board assembly 1 further includes a plurality of shaping blocks 14 (see FIG. 6A) mounted on the figure blocks 121 of the inner board 12 respectively and a plurality of marking members 142 mounted on the shaping blocks 14 respectively. Each of the shaping blocks 14 of the board assembly 1 has a surface provided with at least one slot 141 to allow insertion of a respective one of the marking members 142. Thus, each of the marking members 142 of the board assembly 1 is selectively inserted into the slot 141 of a respective one of the shaping blocks 14, the slot 112 of a respective one of the sections 111 or the slot 122 of a respective one of the figure blocks 121. Each of the shaping blocks 14 of the board assembly 1 has a shape matching that of a respective one of the figure blocks 121 of the inner board 12 so that each of the shaping blocks 14 of the board assembly 1 corresponds to a respective one of the sections 111 of the outer frame 11 via the respective figure block 121 of the inner board 12.

In practice, it is assumed that each of the sections 111 is a capital unit. Thus, when the player purchases the capital of one of the sections 111, the respective shaping block 14 is placed on the respective figure block 121 corresponding to the respective section 111 to indicate that the capital of the respective section 111 is owned by the player. In addition, the respective marking members 142 is mounted on the respective shaping block 14 to provide a marking.

The operation unit 2 includes a plurality of identification blocks 21 mounted on the sections 111 of the outer frame 11 respectively, a plurality of three-dimensional blocks 22 selectively mounted on the sections 111 of the outer frame 11 respectively, a plurality of movers 23 movable on the sections 111 of the outer frame 11 respectively, and a plurality of counters (such as dices) 24 mating with the movers 23 respectively to count the number of movement of the movers 23. Each of the identification blocks 21 of the operation unit 2 is placed on and has a shape matching that of the second zone 1112 of a respective one of the sections 111. Each of the three-dimensional blocks 22 of the operation unit 2 has a bottom provided with an insert 221 inserted into the slot 112 of a respective one of the sections 111.

In practice, when the player purchases the capital of one of the sections 111, the respective identification block 21 of the operation unit 2 is placed on the second zone 1112 of the respective section 111 to indicate that the capital of the respective section 111 is owned by the player. In addition, when the player wishes to increase the capital of one of the sections 111, such as build a house on one of the sections 111, the respective three-dimensional block 22 of the operation unit 2 is placed on the respective section 111 to indicate that the capital of the respective section 111 is increased.

Figure 6:
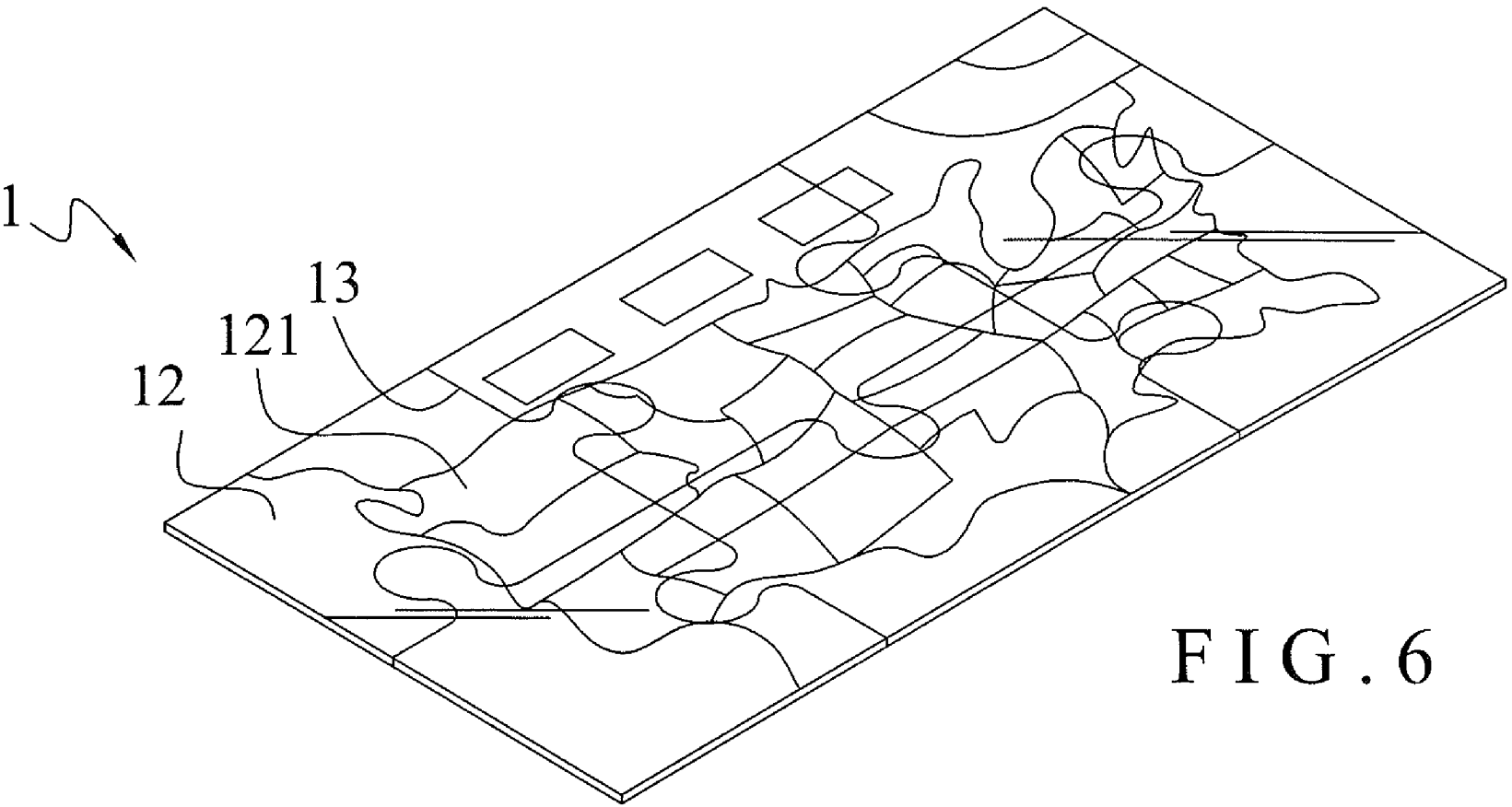
FIG. 6 is a partially perspective view of the board game as shown in FIG. 1.
Figure 6A:
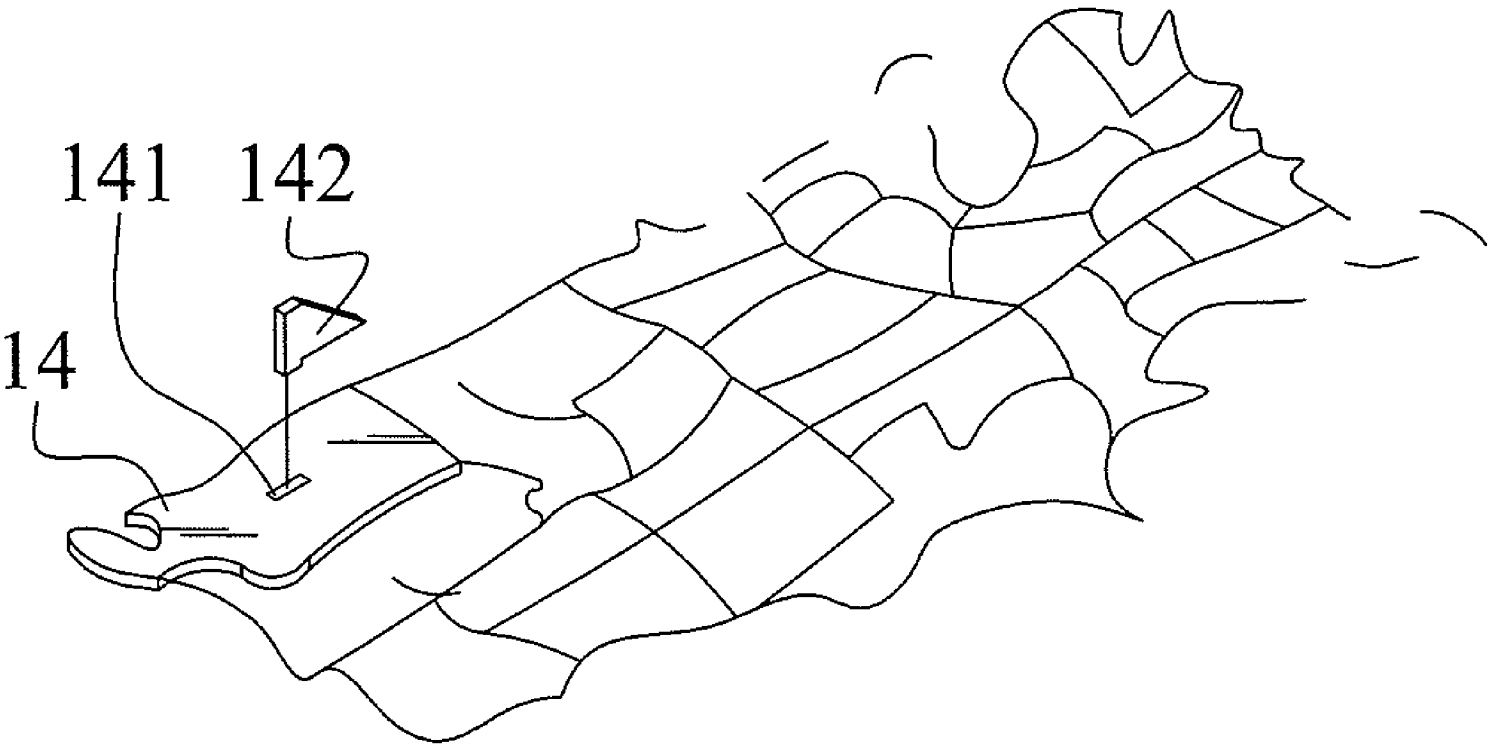
FIG. 6A is a locally enlarged view of the board game as shown in FIG. 6.
Figure 7:
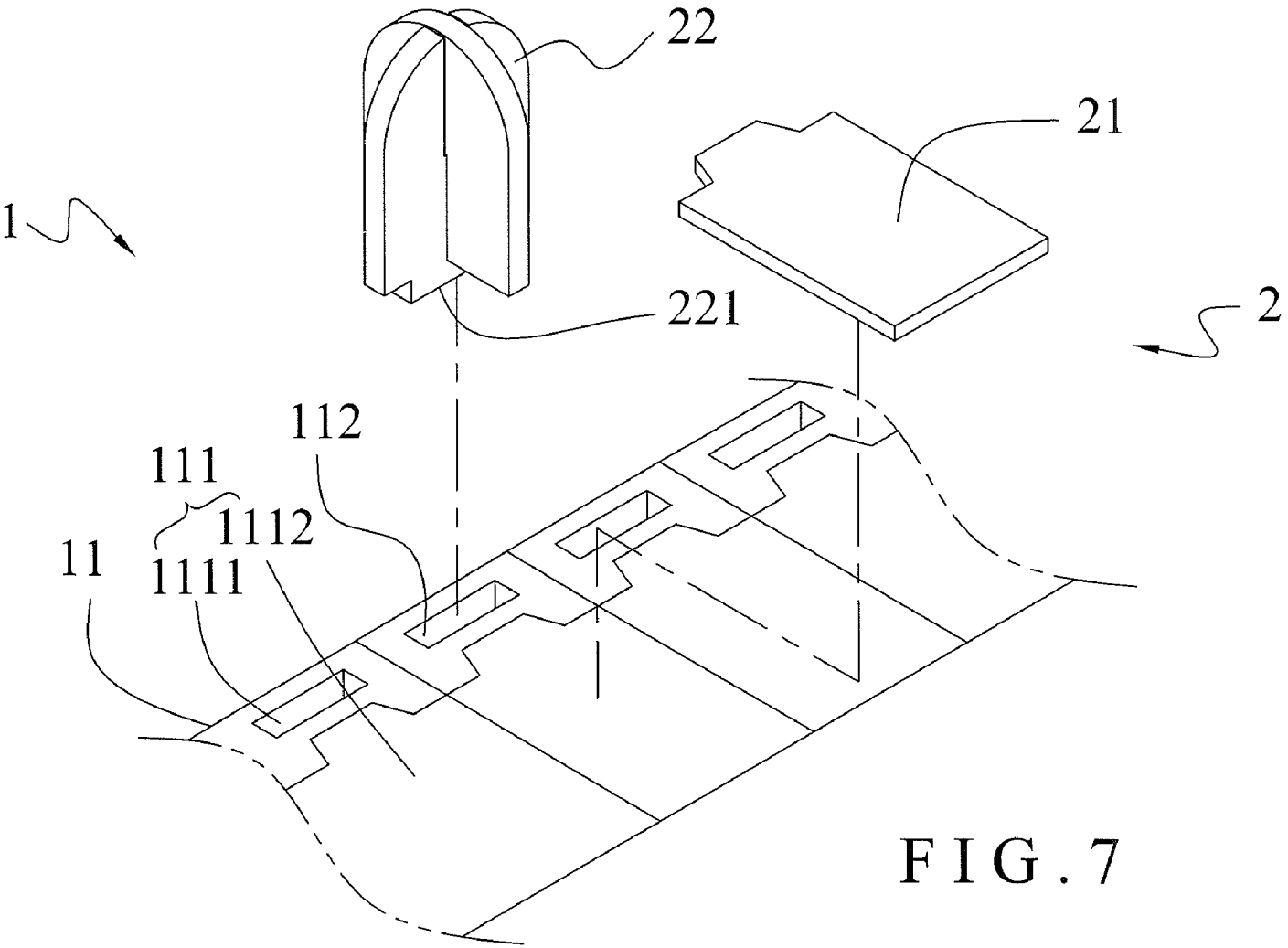
FIG. 7 is a partially perspective exploded view of the board game as shown in FIG. 1.

When in use, again referring to FIGS. 1-7, the board assembly 1 co-operates with the operation unit 2 to function as a monopoly. In such a manner, when each of the movers 23 of the operation unit 2 is moved to one of the sections 111 of the outer frame 11, the player can purchase the respective section 111. At the same time, the respective identification block 21 of the operation unit 2 is placed on the second zone 1112 of the respective section 111 to indicate that the capital of the respective section 111 is owned by the player, while the respective shaping block 14 is placed on the respective figure block 121 as shown in FIG. 6A to also indicate that the capital of the respective section 111 is owned by the player. In addition, when the respective mover 23 of the operation unit 2 is again moved to the respective section 111 of the outer frame 11, the player can also increase the capital of the respective section 111. At the same time, the respective three-dimensional block 22 of the operation unit 2 is placed on the respective section 111 to indicate that the capital of the respective section 111 is increased. Thus, when other player is moved into the respective section 111, he/she has to pay the related capital of the respective section 111.

As shown in FIG. 3, the separating edges 13 of the board assembly 1 divides the outer frame 11 and the inner board 12 of the board assembly 1 into a plurality of pieces so that the pieces of the outer frame 11 and the inner board 12 of the board assembly 1 are combinable and detachable. Thus, the outer frame 11 and the inner board 12 of the board assembly 1 co-operate to function as a puzzle.

As shown in FIG. 4, the inner board 12 of the board assembly 1 is detached from the outer frame 11 of the board assembly 1 so that the outer frame 11 and the inner board 12 of the board assembly 1 are used individually.

As shown in FIG. 5, the inner board 12 of the board assembly 1 is used individually to function as a puzzle.

Figure 8:
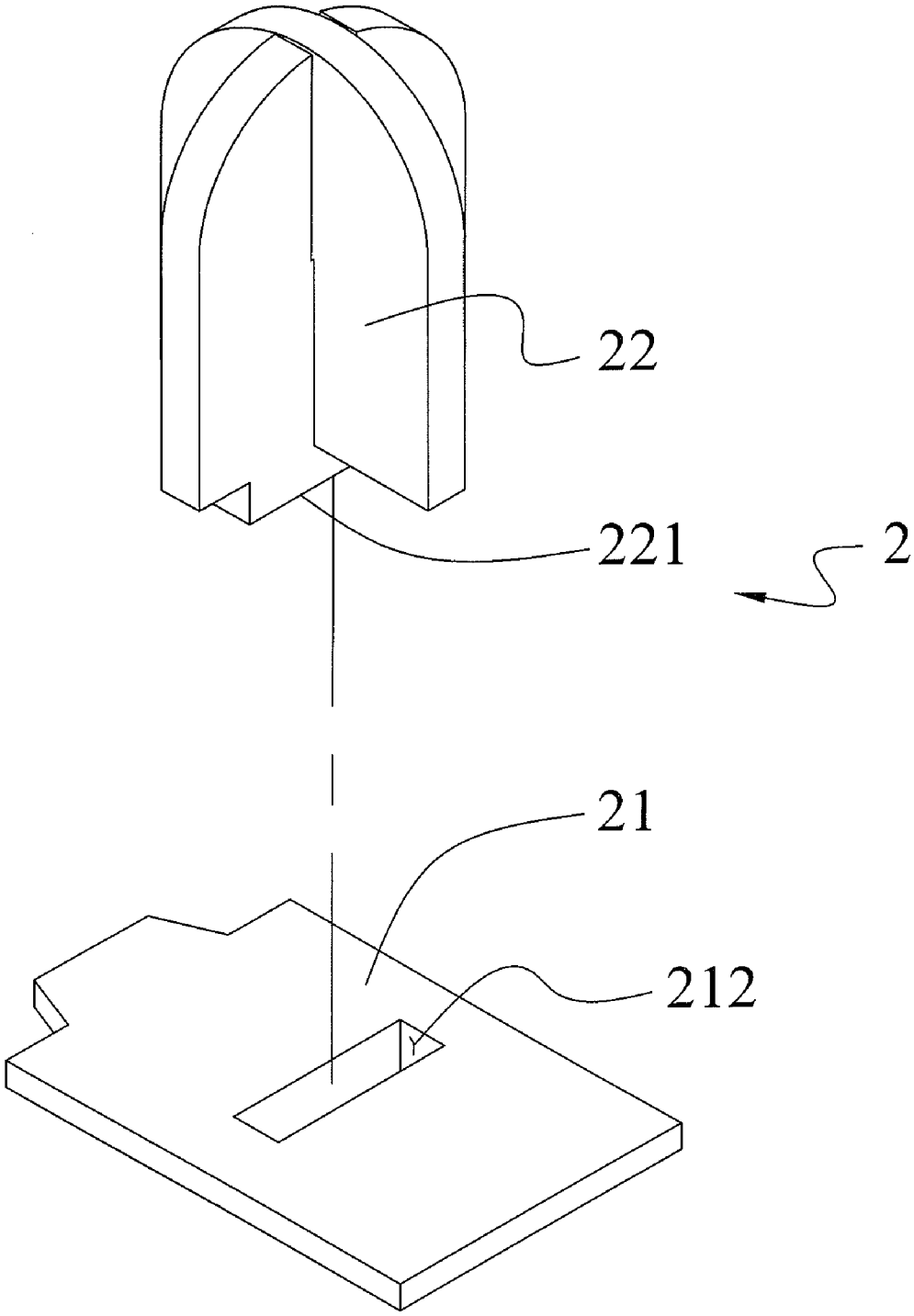
FIG. 8 is a partially exploded perspective view of an operation unit of the board game in accordance with another preferred embodiment of the present invention.

Referring to FIG. 8, each of the identification blocks 21 of the operation unit 2 has a surface provided with at least one slot 212, and each of the three-dimensional blocks 22 of the operation unit 2 has a bottom provided with an insert 221 inserted into the slot 212 of a respective one of the identification blocks 21 to increase the capital of each of the sections 111.

Figure 9:
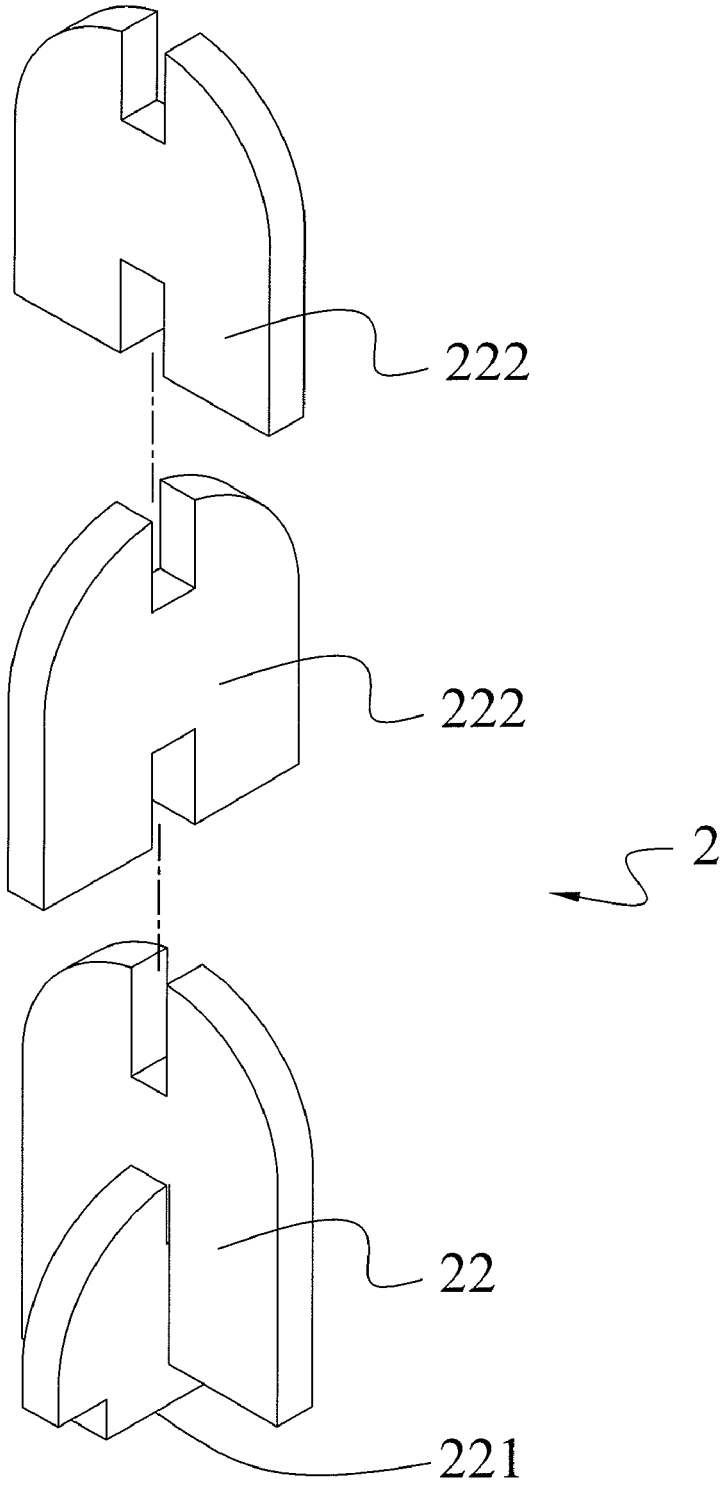
FIG. 9 is a partially exploded perspective view of an operation unit of the board game in accordance with another preferred embodiment of the present invention.

Referring to FIG. 9, the operation unit 2 further includes a plurality of laminating blocks 222 mounted on the three-dimensional blocks 22 respectively and laminating each other to increase the capital of each of the sections 111.

Figure 10:
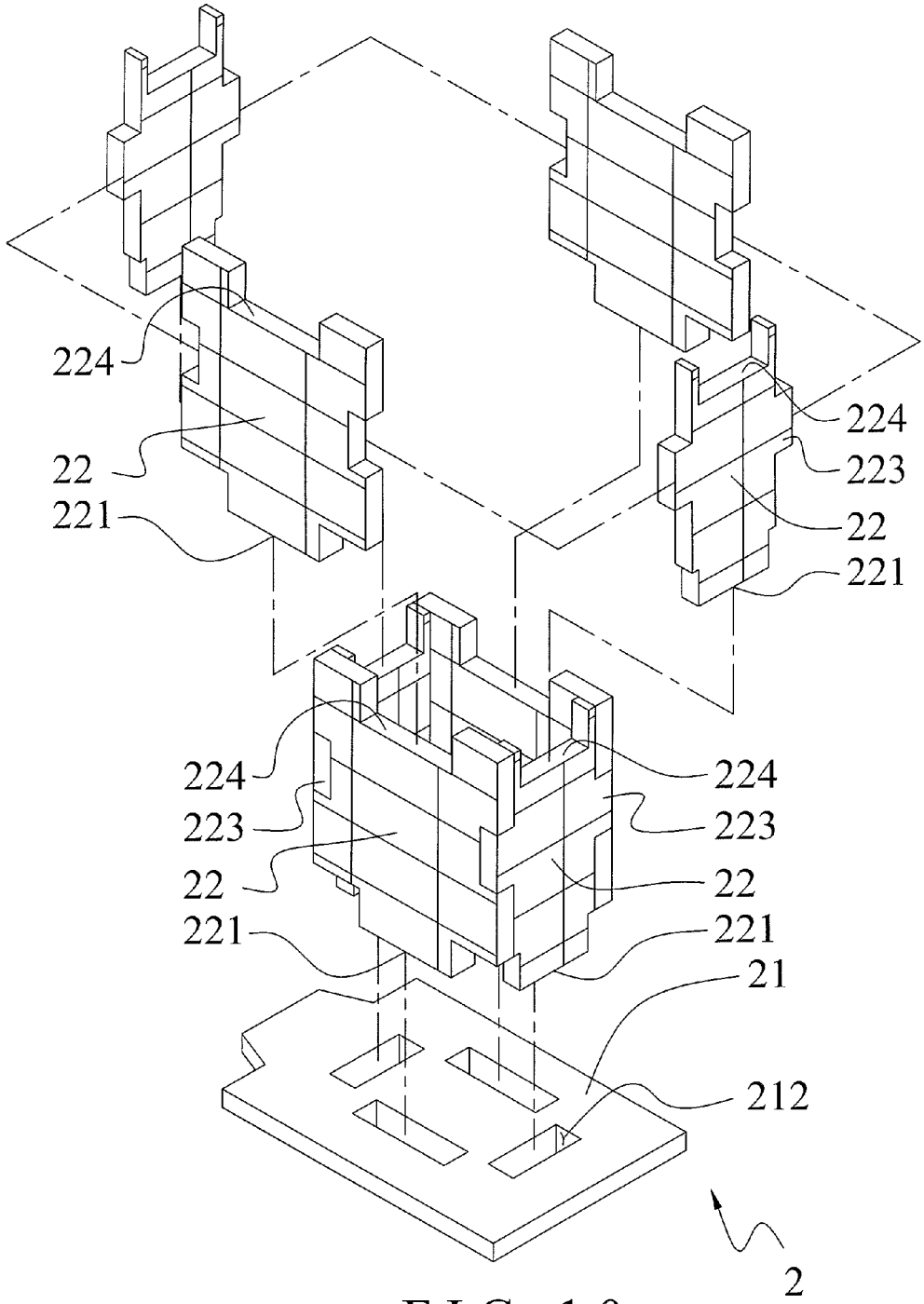
FIG. 10 is a partially exploded perspective view of an operation unit of the board game in accordance with another preferred embodiment of the present invention.

Referring to FIG. 10, the operation unit 2 includes a plurality of identification blocks 21 mounted on the sections 111 of the outer frame 11 respectively, a plurality of three-dimensional blocks 22 detachably mounted on the identification blocks 21 respectively and detachably combined with each other, a plurality of movers 23 movable on the sections 111 of the outer frame 11 respectively, and a plurality of counters 24 mating with the movers 23 respectively. Each of the identification blocks 21 of the operation unit 2 has a surface provided with a plurality of slots 212. Each of the three-dimensional blocks 22 of the operation unit 2 has a bottom provided with an insert 221 inserted into the respective slot 212 of a respective one of the identification blocks 21. Each of the three-dimensional blocks 22 of the operation unit 2 is provided with a plurality of tenons 223 and a plurality of mortises 224. Thus, the tenons 223 of one of the three-dimensional blocks 22 are inserted into the mortises 224 of another one of the three-dimensional blocks 22 so that the three-dimensional blocks 22 of the operation unit 2 are combined together.

Figure 11:
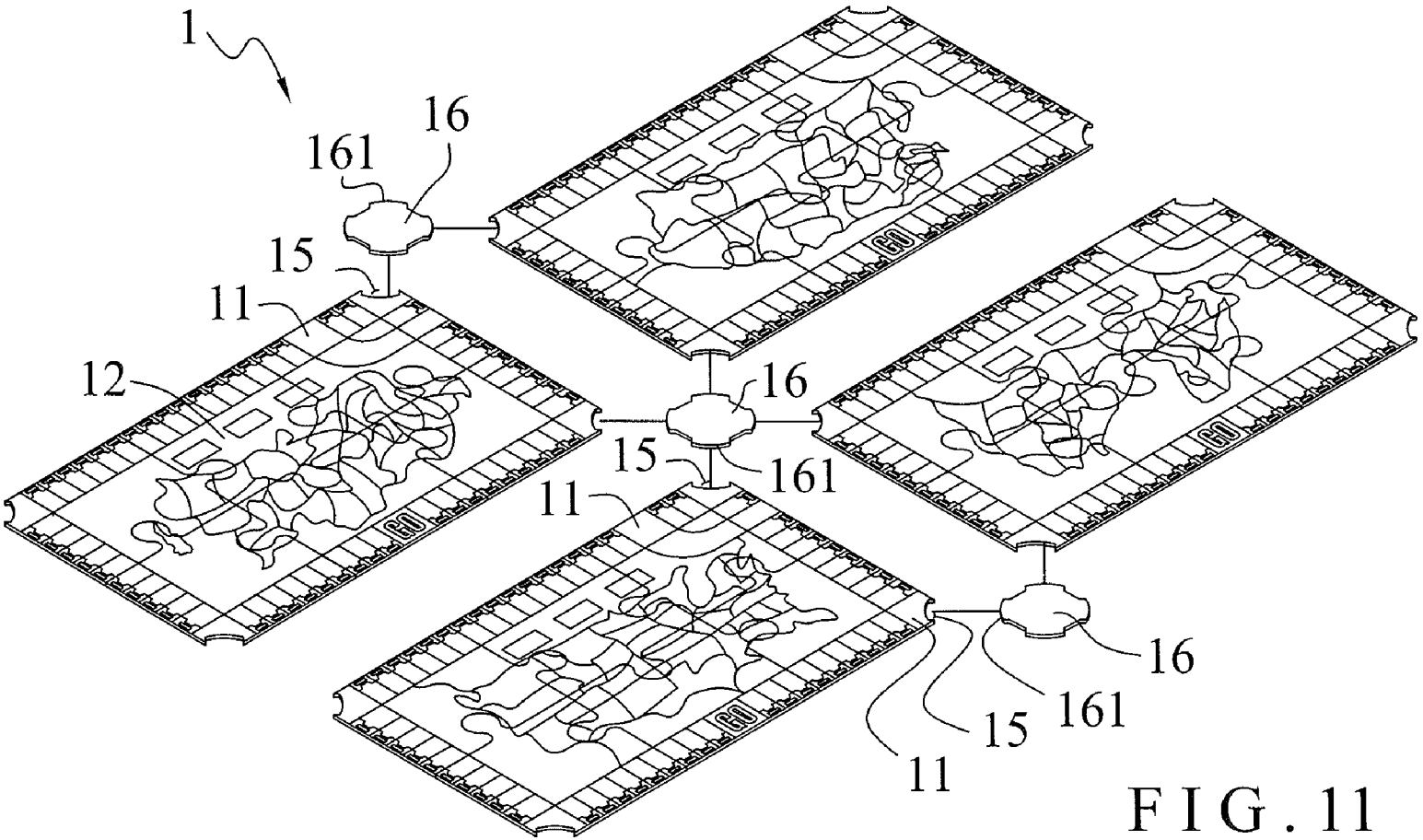
FIG. 11 is a partially exploded perspective view of a board assembly of the board game in accordance with another preferred embodiment of the present invention.
Figure 12:
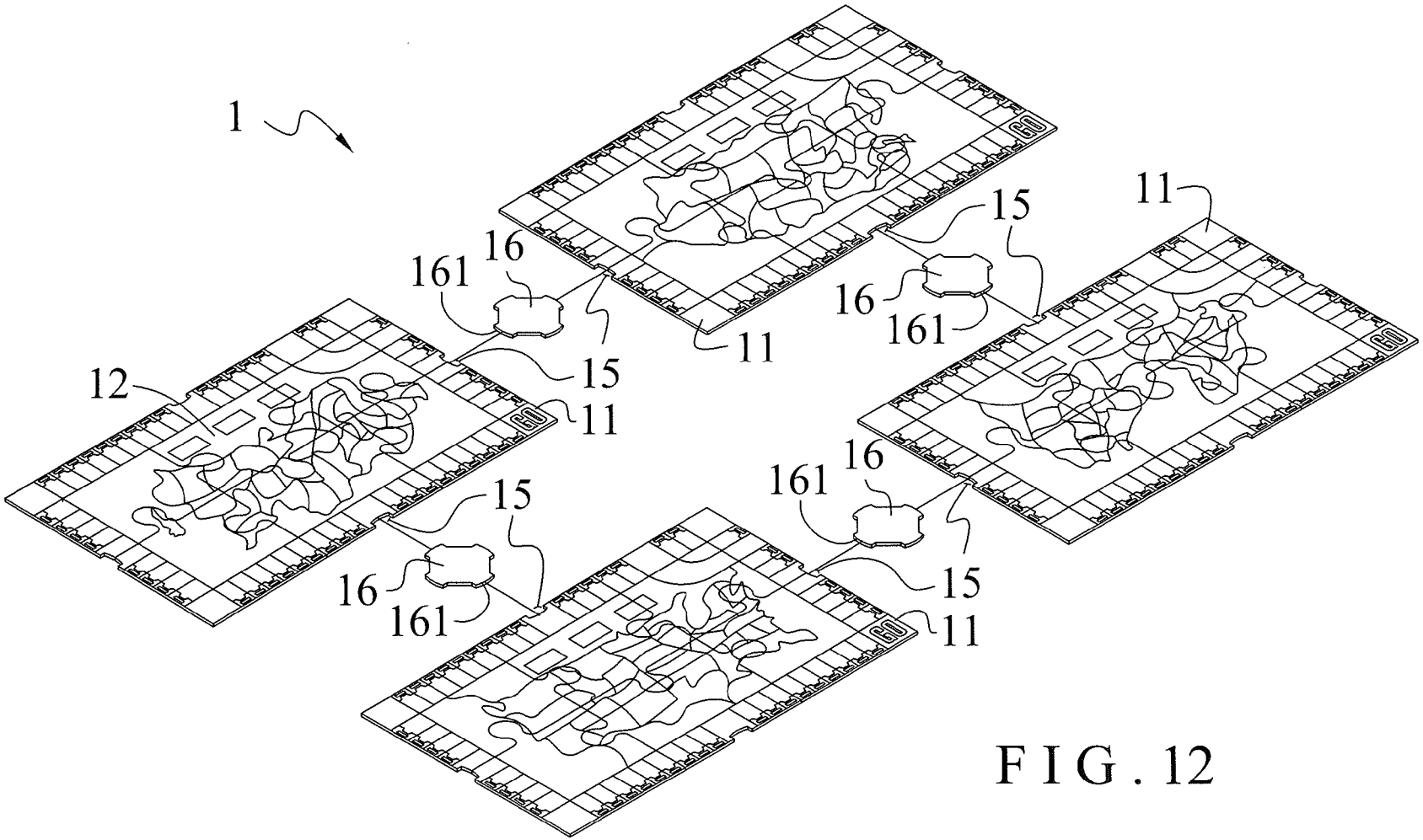
FIG. 12 is a partially exploded perspective view of a board assembly of the board game in accordance with another preferred embodiment of the present invention.

Referring to FIGS. 11 and 12, the board assembly 1 includes a plurality of outer frames 11 and a plurality of inner boards 12 mounted in the outer frames 11 respectively, and further includes a plurality of connecting blocks 16 mounted between the outer frames 11 to connect the outer frames 11. Each of the outer frames 11 has a periphery provided with a plurality of grooves 15, and each of the connecting blocks 16 has a periphery provided with a plurality of lugs 161 inserted into the grooves 15 of each of the outer frames 11 respectively to connect each of the connecting blocks 16 with each of the outer frames 11 respectively.

Figure 13:
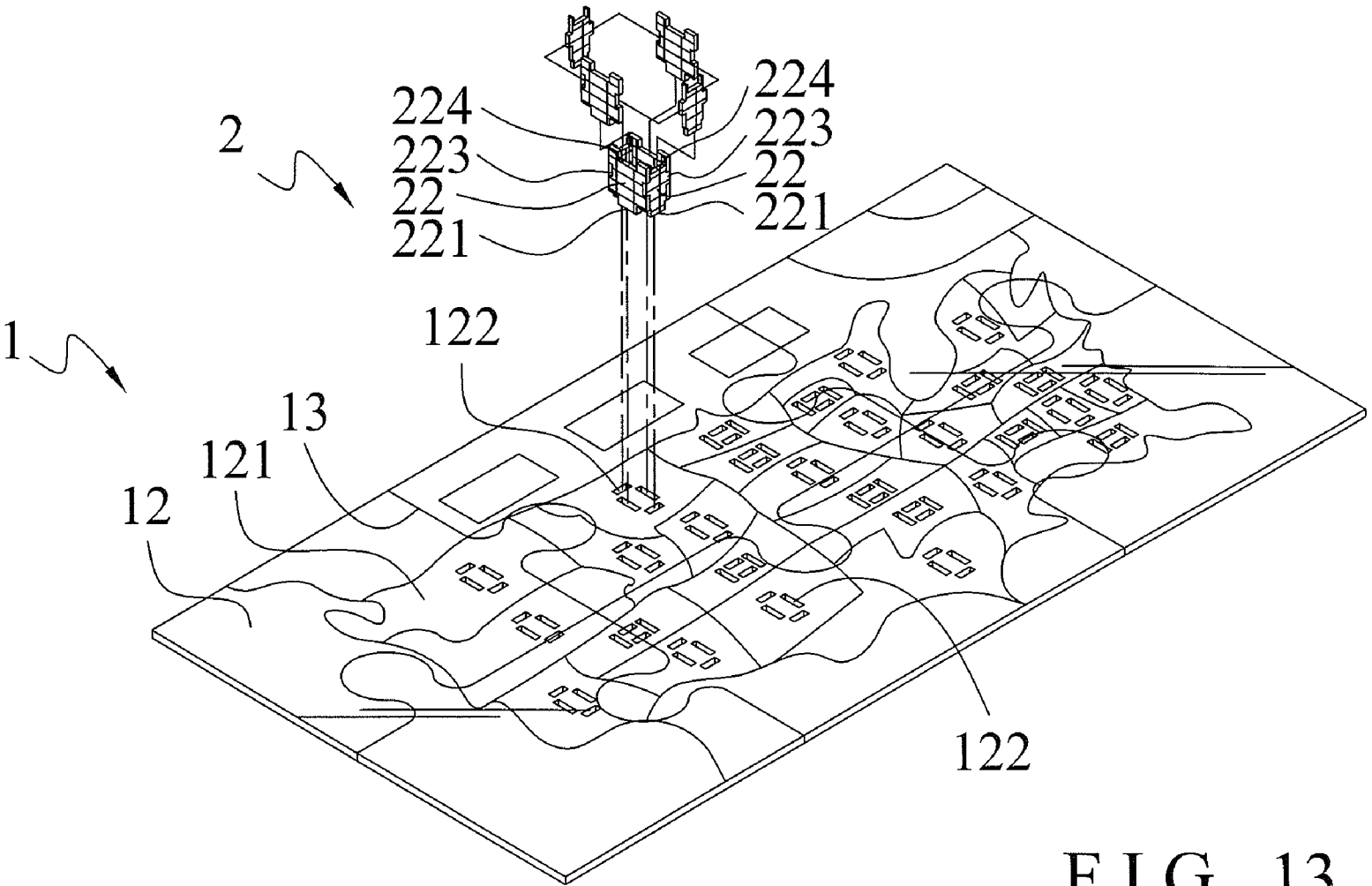
FIG. 13 is a partially exploded perspective view of the board game in accordance with another preferred embodiment of the present invention.

Referring to FIG. 13, the inner board 12 of the board assembly 1 includes a plurality of figure blocks 121 which have an information corresponding to that of the sections 111 of the outer frame 11 respectively, and the operation unit 2 includes a plurality of three-dimensional blocks 22 detachably mounted on the figure blocks 121 of the inner board 12 respectively and detachably combined with each other. Each of the figure blocks 121 of the inner board 12 has a surface provided with a plurality of slots 122. Each of the three-dimensional blocks 22 of the operation unit 2 has a bottom provided with an insert 221 inserted into the respective slot 122 of a respective one of the figure blocks 121. Each of the three-dimensional blocks 22 of the operation unit 2 is provided with a plurality of tenons 223 and a plurality of mortises 224. Thus, the tenons 223 of one of the three-dimensional blocks 22 are inserted into the mortises 224 of another one of the three-dimensional blocks 22 so that the three-dimensional blocks 22 of the operation unit 2 are combined together.

Figure 14:
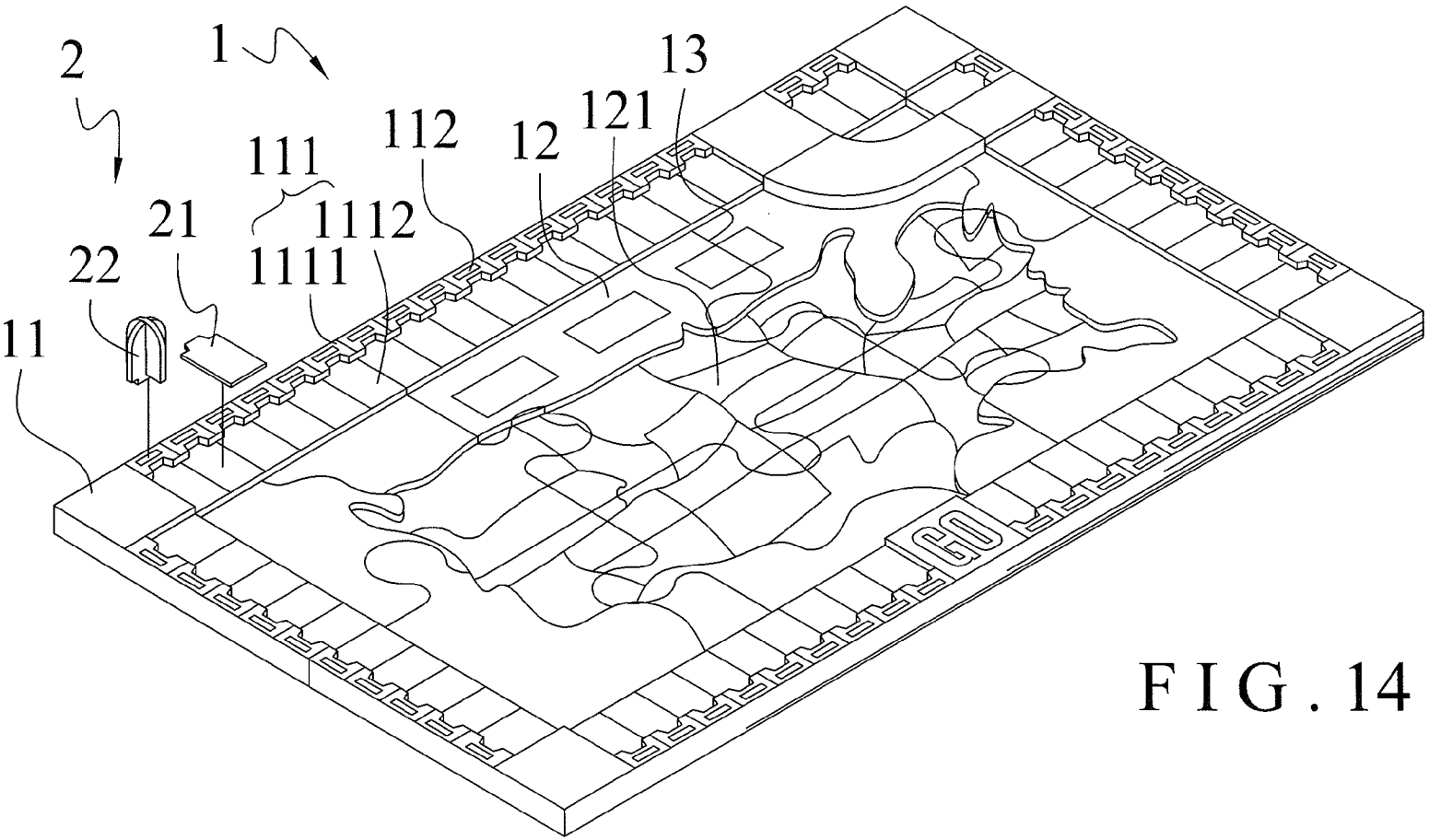
FIG. 14 is a perspective view of the board game in accordance with another preferred embodiment of the present invention.
Figure 15:
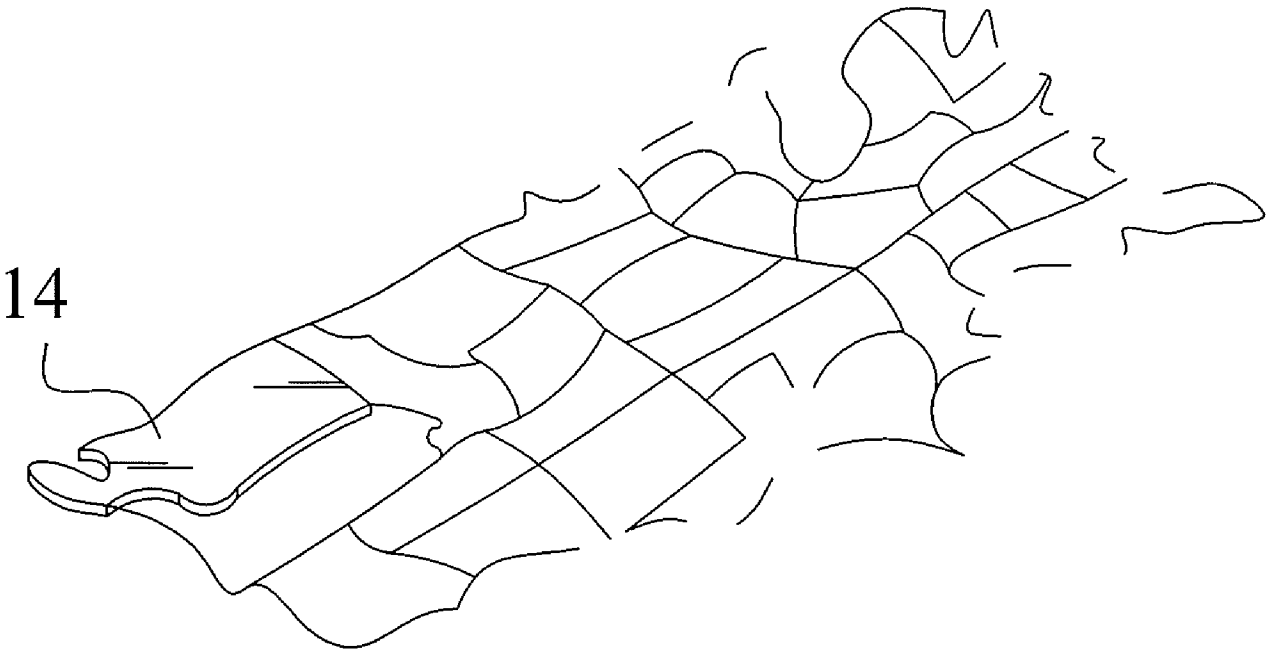
FIG. 15 is a locally enlarged view of the board game as shown in FIG. 14.

Referring to FIGS. 14 and 15, the outer frame 11 has a stepped shape, and the inner board 12 also has a stepped shape so that the board assembly 1 has a three-dimensional effect.

Accordingly, the outer frame 11 and the inner board 12 of the board assembly 1 co-operate to function as a monopoly and a puzzle to facilitate a player or many players playing the monopoly and the puzzle so as to enhance the amusement of playing the board game. In addition, the board assembly 1 includes a plurality of connecting blocks 16 mounted between the outer frames 11 to connect the outer frames 11 so as to expand the board game. Further, both of the outer frame 11 and the inner board 12 have a stepped shape so that the board assembly 1 has a three-dimensional effect to enhance the aesthetic quality of the board game.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A board game, comprising:

a board assembly;

an operation unit mating with the board assembly; wherein the board assembly includes:

at least one outer frame;

at least one inner board mounted in the outer frame;

a plurality of separating edges located in the outer frame and the inner board to separate the outer frame and the inner board respectively;

the outer frame of the board assembly includes a plurality of sections which are juxtaposed and combined to form an endless loop;

the operation unit includes:

a plurality of identification blocks detachably mounted on the sections of the outer frame respectively to identify the sections of the outer frame;

a plurality of three-dimensional blocks selectively and detachably mounted on the sections of the outer frame respectively to identify the sections of the outer frame;

a plurality of movers movable on the sections of the outer frame respectively to present numbers of movement on the sections of the outer frame;

a plurality of counters mating with the movers respectively to count the numbers of movement of the movers on the sections of the outer frame;

the movers of the operation unit are detachable from the sections of the outer frame respectively;

each of the sections of the outer frame has a surface provided with at least one slot;

each of the three-dimensional blocks of the operation unit has a bottom provided with an insert inserted into the slot of a respective one of the sections.

2. The board game of claim 1, wherein the inner board of the board assembly is detachably mounted in and surrounded by the outer frame so that the inner board of the board assembly can be detached from the outer frame;

each of the sections of the outer frame includes a first zone and a second zone juxtaposed to the first zone.

3. The board game of claim 1, wherein the separating edges of the board assembly divides the outer frame and the inner board of the board assembly into a plurality of pieces so that the pieces of the outer frame and the inner board of the board assembly are combinable and detachable;

the separating edges of the board assembly includes a plurality of concave portions corresponding to some of the pieces of the board assembly respectively and a plurality of convex portions corresponding to some of the pieces of the board assembly respectively and detachably inserted into the concave portions to combine or detach the pieces of the board assembly respectively.

4. The board game of claim 1, wherein the outer frame has a stepped shape;

the inner board has a stepped shape;

the board assembly has a three-dimensional effect.

5. The board game of claim 1, wherein each of the identification blocks of the operation unit has a shape matching that of a respective one of the sections.

6. The board game of claim 1, wherein the inner board of the board assembly includes a plurality of figure blocks which have an information of figures corresponding to that of the sections of the outer frame respectively to identify the sections of the outer frame.

7. The board game of claim 6, wherein the board assembly further includes:

a plurality of shaping blocks detachably mounted on the figure blocks of the inner board respectively to identify the sections of the outer frame;

a plurality of marking members detachably mounted on the shaping blocks respectively to identify the sections of the outer frame.

8. The board game of claim 7, wherein each of the shaping blocks of the board assembly has a surface provided with at least one slot to allow insertion of a respective one of the marking members.

9. The board game of claim 8, wherein each of the sections of the outer frame has a surface provided with at least one slot;

each of the figure blocks of the inner board has a surface provided with at least one slot;

each of the marking members of the board assembly is selectively inserted into the slot of a respective one of the shaping blocks, the slot of a respective one of the sections or the slot of a respective one of the figure blocks.

10. The board game of claim 1, wherein each of the identification blocks of the operation unit has a surface provided with at least one slot;

each of the three-dimensional blocks of the operation unit has a bottom provided with an insert inserted into the slot of a respective one of the identification blocks.

11. The board game of claim 1, wherein the operation unit further includes:

a plurality of laminating blocks mounted on the three-dimensional blocks respectively and laminating each other to identify the sections of the outer frame respectively.

12. A board game, comprising:

a board assembly;

an operation unit mating with the board assembly; wherein the board assembly includes:

at least one outer frame;

at least one inner board mounted in the outer frame;

a plurality of separating edges located in the outer frame and the inner board to separate the outer frame and the inner board respectively;

the outer frame of the board assembly includes a plurality of sections which are juxtaposed and combined to form an endless loop;

the operation unit includes:

a plurality of identification blocks detachably mounted on the sections of the outer frame respectively to identify the sections of the outer frame;

a plurality of three-dimensional blocks detachably mounted on the identification blocks respectively and detachably combined with each other to identify the sections of the outer frame;

a plurality of movers movable on the sections of the outer frame respectively to present numbers of movement on the sections of the outer frame;

a plurality of counters mating with the movers respectively to count the numbers of movement of the movers on the sections of the outer frame;

the movers of the operation unit are detachable from the sections of the outer frame respectively;

each of the identification blocks of the operation unit has a surface provided with a plurality of slots;

each of the three-dimensional blocks of the operation unit has a bottom provided with an insert inserted into the respective slot of a respective one of the identification blocks;

each of the three-dimensional blocks of the operation unit is provided with a plurality of tenons and a plurality of mortises;

the tenons of one of the three-dimensional blocks are inserted into the mortises of another one of the three-dimensional blocks so that the three-dimensional blocks of the operation unit are combined together.

13. A board game, comprising:

a board assembly;

an operation unit mating with the board assembly; wherein the board assembly includes:

at least one outer frame;

at least one inner board mounted in the outer frame;

a plurality of separating edges located in the outer frame and the inner board to separate the outer frame and the inner board respectively;

the outer frame of the board assembly includes:

a plurality of sections which are juxtaposed and combined to form an endless loop;

the inner board of the board assembly includes:

a plurality of figure blocks which have an information of figures corresponding to that of the sections of the outer frame respectively to identify the sections of the outer frame;

the operation unit includes:

a plurality of three-dimensional blocks detachably mounted on the figure blocks of the inner board respectively and detachably combined with each other to identify the sections of the outer frame;

each of the figure blocks of the inner board has a surface provided with a plurality of slots;

each of the three-dimensional blocks of the operation unit has a bottom provided with an insert inserted into the respective slot of a respective one of the figure blocks;

each of the three-dimensional blocks of the operation unit is provided with a plurality of tenons and a plurality of mortises;

the tenons of one of the three-dimensional blocks are inserted into the mortises of another one of the three-dimensional blocks so that the three-dimensional blocks of the operation unit are combined together.

* * * * *